US010577238B1

(12) United States Patent
Chamoun

(10) Patent No.: US 10,577,238 B1
(45) Date of Patent: Mar. 3, 2020

(54) IDLE FUEL DISPENSER NOZZLE WARNING SYSTEM THAT ALERTS USER TO REPLACE NOZZLE IN NOZZLE BOOT OF DISPENSER

(71) Applicant: Ramzi Chamoun, Long Beach, CA (US)

(72) Inventor: Ramzi Chamoun, Long Beach, CA (US)

( * ) Notice: Subject to any disclaimer, the term of this patent is extended or adjusted under 35 U.S.C. 154(b) by 0 days.

(21) Appl. No.: 16/209,732

(22) Filed: Dec. 4, 2018

(51) Int. Cl.

| | |
|---|---|
| ***G08B 13/14*** | (2006.01) |
| ***B67D 7/32*** | (2010.01) |
| ***G08B 21/18*** | (2006.01) |
| ***G08B 21/24*** | (2006.01) |
| *G08B 5/38* | (2006.01) |

(52) U.S. Cl.
CPC ..... *B67D 7/32* (2013.01); *G08B 21/182* (2013.01); *G08B 21/24* (2013.01); *G08B 5/38* (2013.01)

(58) Field of Classification Search
CPC ..... G07F 13/025; G07F 7/10; G07F 9/023; G07F 7/1033; G07F 7/1041; G07F 7/1075; G07F 9/026; G06Q 20/12; G06Q 20/18; G06Q 20/202; G06Q 30/06; G06Q 20/206; G06Q 20/42; G06Q 30/0635; G06Q 50/06; G06Q 20/347; G06Q 20/3829; G06Q 30/0241; G06Q 30/0621; G06Q 30/0641; B67D 7/348; B67D 7/04; B67D 7/08; B67D 7/22; G07G 1/12; G02F 1/167; G06F 3/023; G06F 3/0481; G06F 3/0489; G06F 17/5004; G09G 2310/068; G09G 3/344
USPC ..... 340/568.1, 539.1, 457, 450.2, 450, 340/460–462, 525, 582, 632, 691.6
See application file for complete search history.

(56) References Cited

U.S. PATENT DOCUMENTS

| | | | | |
|---|---|---|---|---|
| 8,554,688 | B2 * | 10/2013 | Harrell | G06Q 20/347 705/64 |
| 2011/0185319 | A1 * | 7/2011 | Carapelli | G06Q 20/206 715/863 |
| 2011/0273371 | A1 * | 11/2011 | Payne | G07F 7/1033 345/168 |
| 2012/0018446 | A1 * | 1/2012 | Tague | B67D 7/04 222/25 |
| 2012/0059694 | A1 * | 3/2012 | Kuebert | G06Q 20/206 705/14.4 |
| 2012/0162422 | A1 * | 6/2012 | Lester | G07F 13/025 348/148 |

* cited by examiner

*Primary Examiner* — Daniel Previl
(74) *Attorney, Agent, or Firm* — Plager Schack LLP; Mark H. Plager; Stephen Hallberg

(57) ABSTRACT

An idle fuel dispenser nozzle warning system that alerts a user to replace the nozzle in a nozzle boot of the fuel dispenser after fuel stops flowing through the nozzle and an idle fuel dispenser nozzle warning process for detecting inactivity by a nozzle removed from a nozzle boot of a fuel dispenser and activating a sensory alarm to remind a user to replace the nozzle in the nozzle boot of the fuel dispenser are disclosed. The system and process provide dynamic sensory warnings using sound and lights to get distracted people's attention to avoid wasted money, time, and environmental consequences of leaving the nozzle in the gas tank opening while driving away.

12 Claims, 4 Drawing Sheets

IDLE FUEL DISPENSER NOZZLE WARNING SYSTEM THAT ALERTS USER TO REPLACE NOZZLE IN NOZZLE BOOT OF DISPENSER

BACKGROUND

Embodiments of the invention described in this specification relate generally to warning systems, and more particularly, to an idle fuel dispenser nozzle warning system that alerts a user to replace the nozzle in a nozzle boot of the fuel dispenser and an idle fuel dispenser nozzle warning process for detecting inactivity by a nozzle removed from a nozzle boot of a fuel dispenser and activating a sensory alarm to remind a user to replace the nozzle in the nozzle boot of the fuel dispenser.

After removing a fuel nozzle from the nozzle boot of a fuel dispenser and pumping fuel into their vehicle, a driver may forget to remove the fuel nozzle from their fuel tank to replace it in the nozzle boot of the fuel dispenser, but instead, may inadvertently drive away with the nozzle still in their vehicle. This causes downtime for the gas station, repair costs, and environmental damage. This is a problem because humans are not infallible, so reliance on humans in not enough. The downtime and cost incurred by gas station owners remains too high not to address this problem. When the environmental impact is considered, the consequences of not solving this problem can be staggering.

Therefore, what is needed is a way to ensure that people replace the nozzle back in the nozzle boot of the fuel dispenser when they are done pumping fuel and before driving their vehicle away to prevent damage, loss, and environment harm.

BRIEF DESCRIPTION

Some embodiments of the invention include a novel idle fuel dispenser nozzle warning system that alerts a user to replace the nozzle in a nozzle boot of the fuel dispenser after fuel stops flowing through the nozzle and a novel idle fuel dispenser nozzle warning process for detecting inactivity by a nozzle removed from a nozzle boot of a fuel dispenser and activating a sensory alarm to remind a user to replace the nozzle in the nozzle boot of the fuel dispenser. The system and process provide dynamic sensory warnings using sound and lights to get distracted people's attention to avoid wasted money, time, and environmental consequences of leaving the nozzle in the gas tank opening while driving away. In some embodiments, the lights are used to alert people who are hearing impaired.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Having described the invention in general terms, reference is now made to the accompanying drawings, which are not necessarily drawn to scale, and wherein.

DETAILED DESCRIPTION

Figure 1:
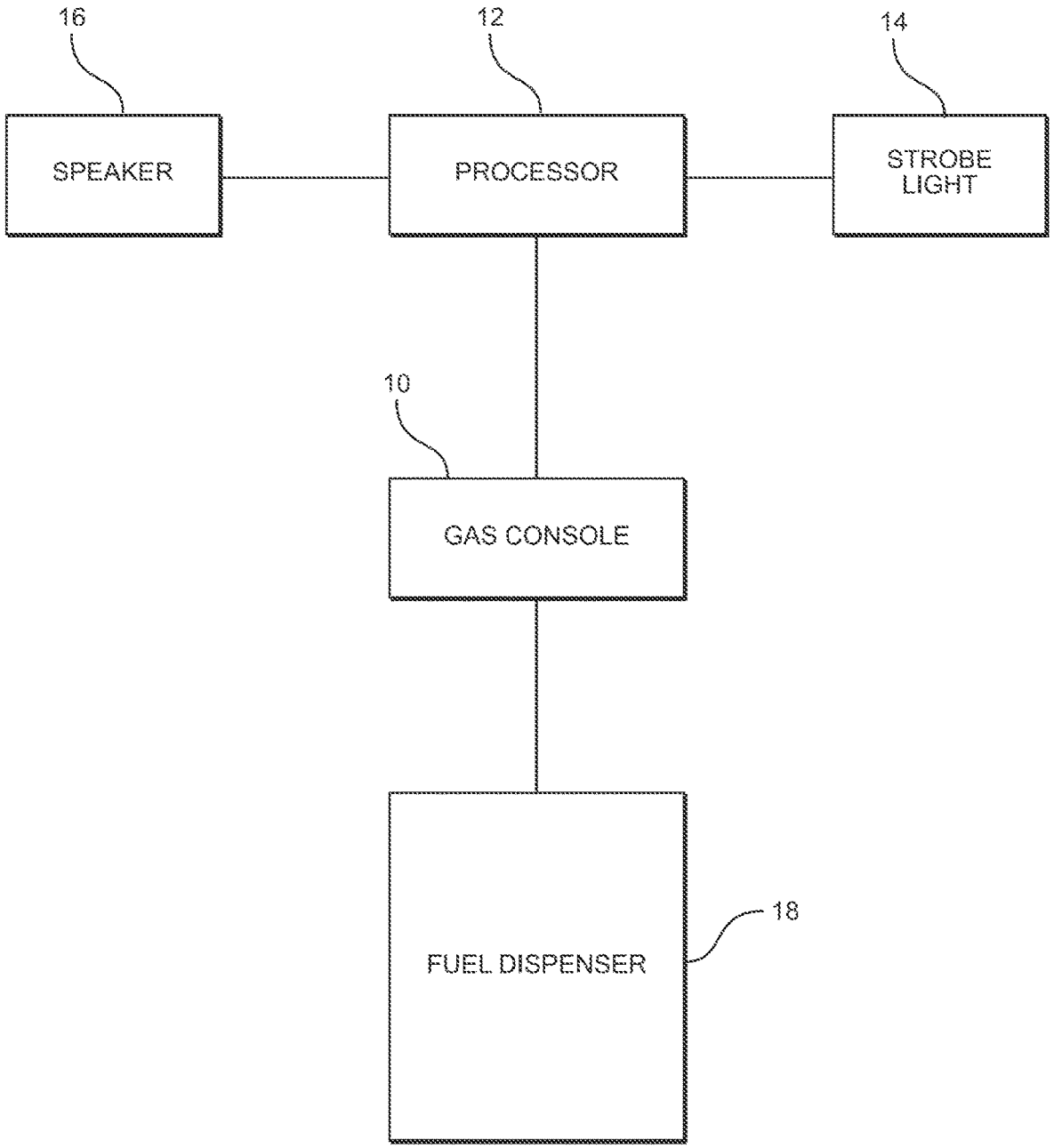
FIG. 1 conceptually illustrates a block diagram of several components of an idle fuel dispenser nozzle warning system in some embodiments.

In the following detailed description of the invention, numerous details, examples, and embodiments of the invention are described. However, it will be clear and apparent to one skilled in the art that the invention is not limited to the embodiments set forth and that the invention can be adapted for any of several applications.

Some embodiments of the invention include a novel idle fuel dispenser nozzle warning system that alerts a user to replace the nozzle in a nozzle boot of the fuel dispenser after fuel stops flowing through the nozzle and a novel idle fuel dispenser nozzle warning process for detecting inactivity by a nozzle removed from a nozzle boot of a fuel dispenser and activating a sensory alarm to remind a user to replace the nozzle in the nozzle boot of the fuel dispenser. The system and process provide dynamic sensory warnings using sound and lights to get distracted people's attention to avoid wasted money, time, and environmental consequences of leaving the nozzle in the gas tank opening while driving away. In some embodiments, the lights are used to alert people who are hearing impaired.

As stated above, drivers sometimes forget to remove the fuel nozzle from their fuel tank to replace it in the nozzle boot of the fuel dispenser, and then inadvertently drive away with the nozzle still in their vehicles. This causes downtime for the gas station, repair costs, and environmental damage. This is a problem because humans are not infallible, so reliance on humans in not enough. The downtime and cost incurred by gas station owners remains too high not to address this problem. When the environmental impact is considered, the consequences of not solving this problem can be staggering. Embodiments of the idle fuel dispenser nozzle warning system and the idle fuel dispenser nozzle warning process described in this specification solve such problems by deployment and integration inside the fuel dispenser to monitor the flow of fuel to the vehicle, such that, once fuel stops being dispensed, warning lights and an audible alarm are activated to warn the driver to replace the nozzle in the nozzle boot of the fuel dispenser before driving away from the fuel station.

Embodiments of the idle fuel dispenser nozzle warning system and the idle fuel dispenser nozzle warning process described in this specification differ from and improve upon currently existing options. In particular, there are no similar devices, systems, methods, techniques, etc., used for fuel dispensers or nozzles to date. The existing state relies on human memory—that a driver will remember to replace the nozzle in the fuel dispenser nozzle boot before driving off. Yet, unreplaced nozzle drive-offs continue to happen every day. Other efforts warning drivers using stickers or signs have failed miserably, as evidenced by the continuing problem of drive-offs.

In addition, some embodiments of the idle fuel dispenser nozzle warning system and the idle fuel dispenser nozzle warning process improve upon the currently existing options by providing a dynamic warning system that employs sound and lights (for hearing impaired) to get the attention of forgetful people and distracted people to replace the nozzle in the nozzle boot of the fuel dispenser before driving their vehicle away from the station, and thereby avoid wasted money, time, and environmental consequences. Despite the existence of many modern distractions (e.g., mobile devices, programming content playing on fuel dispenser screens, cell phones, etc.), which generally make it harder for people to focus on simple tasks like finishing the filling-up process and putting the fuel nozzle back, there are no active warning systems to date.

Embodiments of the idle fuel dispenser nozzle warning system and the idle fuel dispenser nozzle warning process of the present disclosure may be comprised of the following elements. This list of possible constituent elements is intended to be exemplary only and it is not intended that this list be used to limit the idle fuel dispenser nozzle warning system and the idle fuel dispenser nozzle warning process of the present application to just these elements. Persons having ordinary skill in the art relevant to the present disclosure may understand there to be equivalent elements that may be substituted within the present disclosure without changing the essential function or operation of the idle fuel dispenser nozzle warning system and the idle fuel dispenser nozzle warning process.

1. Computing device deployed and integrated in a fuel dispenser with a software program that implements the idle fuel dispenser nozzle warning process (e.g., a Raspberry Pi computing device)

2. Speaker that outputs audible warnings

3. Self-contained spark-free warning light (strobe) that outputs visual warnings The idle fuel dispenser nozzle warning system and the idle fuel dispenser nozzle warning process of the present disclosure generally works by the computing device running the software program that implements the idle fuel dispenser nozzle warning process. While the software program running on the computing device measures and monitors the flow of fuel (flow of current of another fluid) via the display, the speaker that outputs audible warnings and the self-contained spark-free warning light (strobe) that outputs visual warnings are controlled by input/output (I/O) switches on the computing device.

By way of example, FIG. 1 conceptually illustrates a block diagram of several components of an idle fuel dispenser nozzle warning system. As shown in this figure, the idle fuel dispenser nozzle warning system includes a gas console 10, a processor 12, a strobe light 14, and a speaker 16, and fuel dispenser 18. The gas console 10 appears at the front face of the fuel dispenser 18 and is communicably connected to the processor 12. The processor 12 is a computing device, such as a Raspberry Pi computing device. As such, the processor 12 includes I/O switches to which the strobe light 14 and the speaker 16 connect to receive signals to activate the visual lighting warnings and the audible warnings, respectively.

Figure 2:
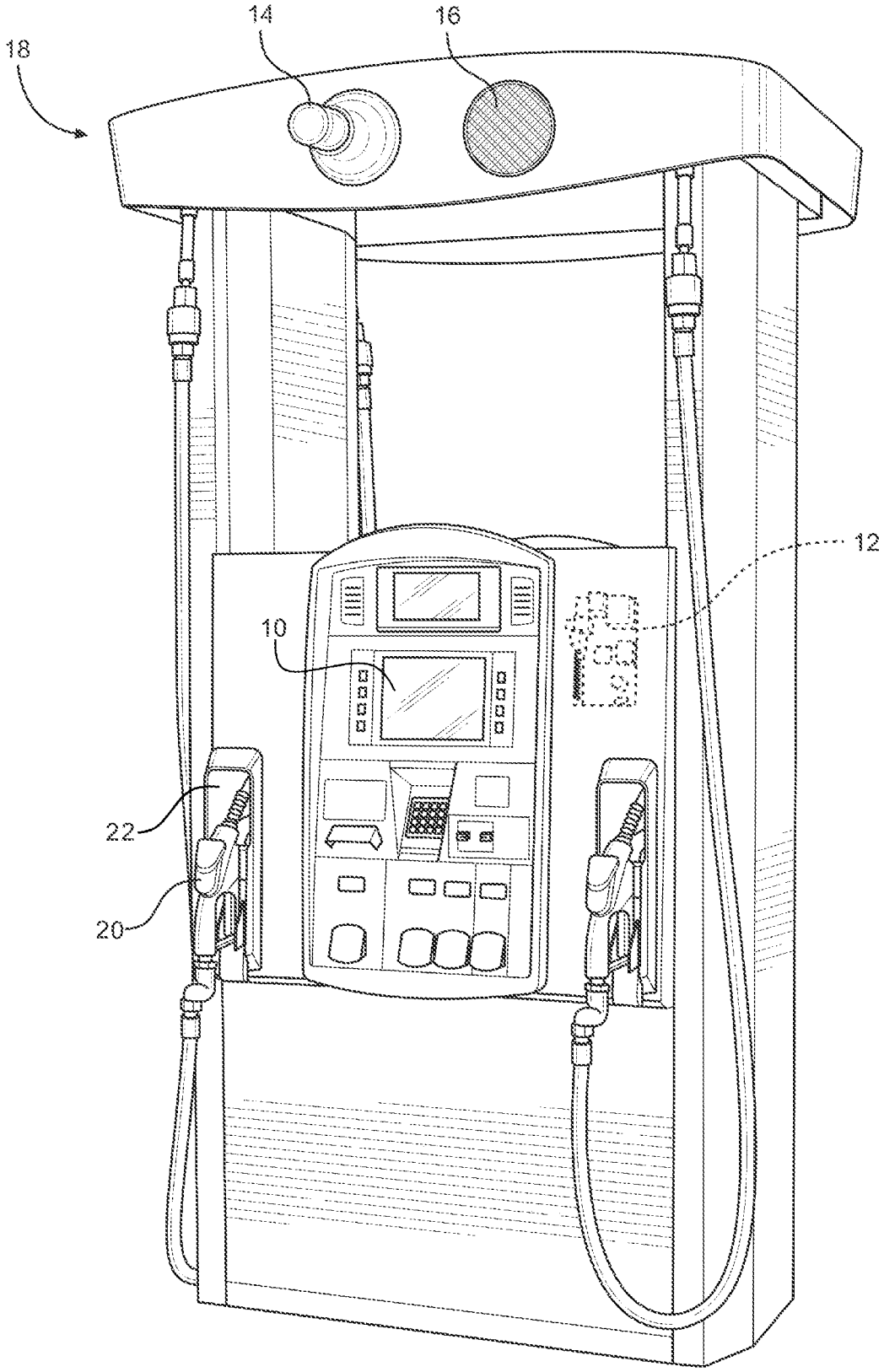
FIG. 2 conceptually illustrates an idle fuel dispenser nozzle warning system deployed in an exemplary fuel dispenser.

Turning to another example, FIG. 2 conceptually illustrates an idle fuel dispenser nozzle warning system deployed in an exemplary fuel dispenser 18. As shown in this figure, the fuel dispenser 18 includes a gas console 10, an internal computing device 12 (shown by dashed outlining), a strobe light 14, a speaker 16, a fuel pump with nozzle 20, and a nozzle boot 22 in which to replace and retain the fuel pump with nozzle 20 when not in use.

The components shown in this figure are related in varying ways within the idle fuel dispenser nozzle warning system. Specifically, fuel is pumped through the fuel pump with nozzle 20 into a vehicle fuel tank by a user. The user may be a driver, passenger, station attendant, etc. The fuel dispenser 18 includes the nozzle boot 22 so that the fuel pump with nozzle 20 can be held and retained safely at the fuel dispenser 18 when not in use. When the user removes the fuel pump with nozzle 20 from the nozzle boot 22, an internal mechanism of the fuel dispenser 18 triggers a request to allow dispensing of fuel. In general, the user will have provided payment information either at the gas console (e.g., via credit or debit card) or by having paid a gas station attendant for a pre-paid amount of fuel. The request to allow dispensing of fuel is not, therefore, a request for fuel to start flowing through the nozzle 20 the moment the user removes the nozzle 20 from the nozzle boot 22. Instead, the fuel dispensing request is a signal that the nozzle 20 is no longer parked in the nozzle boot 22, where fuel cannot be dispensed.

After removing the fuel pump with nozzle 20 from the nozzle boot 22 of the fuel dispenser 18, the user inserts the nozzle 20 into the fuel tank opening that leads to the fuel tank of the vehicle. The user pumps fuel into the vehicle, and when finished, typically replaces the nozzle 20 in the nozzle boot 22 of the fuel dispenser 18. The nozzle boot 22 typically includes a mechanical or electronic switch to indicate when the nozzle 20 has been removed from the nozzle boot (triggering a fuel dispensing request) and when the nozzle 20 has been replaced in the nozzle boot (signifying the end of a fueling transaction). Thus, when the user is finished fueling the vehicle and replaces the nozzle 20 in the nozzle boot 22, the transaction is considered completed and the previously arranged payment method is finalized. For example, the credit card is charged or the debit card is debited, and perhaps a receipt is printed. Even for pre-paid transactions (in which the user pays a gas station attendant for the gas up front before pumping the fuel), the amount of fuel that is dispensed through the nozzle is automatically stopped when the limit is reached.

However, if the user forgets to replace the nozzle 20 in the nozzle boot 22 of the fuel dispenser 18, then the nozzle 20 may end up staying in the fuel tank opening as the vehicle drives off. In this situation, the fuel pump with nozzle 20, the fuel line through which fuel is delivered to the fuel pump with nozzle 20, the fuel dispenser 18, and the vehicle may be damaged. Similarly, fuel may be inadvertently dispensed outside the vehicle, for example, if the vehicle drives away and the fuel pump with nozzle 20 snap free of the vehicle and leaks fuel on the ground, or by damage to the fuel dispenser 18 that causes underground or above ground leaking of fuel or other agents that are dangerous or harmful. This is where the idle fuel dispenser nozzle warning system helps by warning the user or driver of the vehicle that the fuel pump with nozzle 20 has been idle for a period of time (e.g., three seconds, five seconds, etc.) without any flow of fuel occurring. At that point, the software program running on the computing device 12 triggers the speaker 16 to output an audible alarm and the strobe light 14 to flash the light. Once warned, the user/driver may continue to re-engage the flow of fuel (by pumping more fuel into the vehicle or pumping fuel into another container, such as a spare gas tank) or replace the fuel pump with nozzle 20 in the nozzle boot 22 of the fuel dispenser 18, thereby causing the warning alarms to stop sounding (speaker outputting an audible alarm) and flashing lights (visible strobe light flashing). Since the amount of time between the end of fuel being pumped and the warning alarms being triggered is small, there is only a tiny window of time in which the user/driver can drive the vehicle away before the warning alarms start blaring and flashing.

In some embodiments, the computing device comprises a computing device with a small form fact that is embedded inside and integrated with the fuel dispenser 18. For example, a Raspberry Pi computing device is a computer with a small form factor that can be embedded within a fuel dispenser and integrated with other components of the fuel dispenser, such as the fuel dispenser's gas console. Thus, the computer may be a Raspberry Pi computing device on which a software program is installed and runs to identify a stop in the flow of current/information via gas console (or the digital LCD display of the gas console) which indicates that fuel pumping has started and when it has stopped. Alternatively, a small integrated circuit board may be programmed, embedded in the fuel dispenser, and carry out the functions of the system.

In some embodiments, when the software program detects a first triggering event, namely, a stop of the flow of current for more than a first duration of time (e.g., three seconds, ten seconds, etc.), the software program triggers an audible signal to be blared out of the speaker and a visual lighting signal to be flashed from the self-contained spark-free warning light, which may be a strobe light. The audible and visible warnings are triggered so as to prompt the user to either re-position the nozzle or replace the nozzle in the nozzle boot of the fuel dispenser to finalize the transaction. After triggering the audible and visible warnings, the software program continues to track time.

In some embodiments, each triggering event of the idle fuel dispenser nozzle warning system is a timed event. A timed event, for purposes of the idle fuel dispenser nozzle warning system and idle fuel dispenser nozzle warning process described in this disclosure, means the software program tracks time from the identification of a first event (stop of the flow of the fuel). However, a detected stop in the flow of fuel can be followed by a continuation of the flow of fuel, which then resets the tracked time and resets the first event so that the stop of the flow of fuel is still actively monitored.

In some embodiments, a second duration of time is associated with a second triggering event that causes the same warnings to be activated (both visible lights and audible sound). The second duration of time may be a longer period of time than the first duration of time (e.g., fifteen seconds, twenty seconds, etc.).

In some embodiments, the visible and audible warnings are triggered to activate louder and brighter than the visible and audible warnings triggered after the first duration of time. The volume and brightness of the warnings continues to increase at defined time intervals. For example, after ten seconds, a third triggering event causes the volume of the audible warning and the brightness of the flashing light warning to increase, and after another five seconds, a fourth triggering event causes the further increases in the volume and light intensity. After the fourth triggering event, additional triggering events may be captured by the software program running on the computing device. In some embodiments, the idle fuel dispenser nozzle warning system and the idle fuel dispenser nozzle warning process stop all warnings at the moment the nozzle is replaced in the nozzle boot of the corresponding fuel pump.

In some embodiments, the first, second, third, and fourth triggering events are defined as configurable timed events. In some embodiments, the times associated with the first, second, third, and fourth triggering events are adjustable. In some embodiments, additional triggering events a configurable and adjustable. For example, after the fourth triggering event, subsequent triggering events may increase volume and light intensity every five seconds, and continuing at five second intervals until the nozzle is replaced in the nozzle boot of the fuel pump or the system is shut down at the corresponding fuel pump.

While the software program running on the computing device measures and monitors the flow of fuel (flow of current of another fluid) via the display, the speaker that outputs audible warnings and the self-contained spark-free warning light (strobe) that outputs visual warnings are controlled by input/output (I/O) switches on the computing device.

In some embodiments, the volume of the audible warnings and the brightness (intensity of flashing light) of the visible warnings are configurable and adjustable. In some embodiments, the first and second durations of time are configurable and adjustable. In some embodiments, the software program running on the computing device includes a user interface (UI) with UI tools for adjusting the configurable volume of the audible warnings, the brightness of the visible warnings, and the first and second durations of time. In this way, the time durations, the brightness of visible warnings, and the volume of audible warnings can be changed to suit local needs and expectations of each individual fuel station or to meet city ordinance requirements, etc.

To make the idle fuel dispenser nozzle warning system of the present disclosure, a person may gather the basic components, connect them all together, and write a small program to install and run on the computing device in order to monitor the signal, capture the timed events, and trigger the audible and visual alarm warnings as needed. After the pump has been stopped and the fuel transaction is completed without incident, the idle fuel dispenser nozzle warning system automatically resets and is ready to monitor the next fuel transaction.

The above-described embodiments of the invention are presented in relation to examples for making and using the idle fuel dispenser nozzle warning system, all embodiments are described for purposes of illustration and not of limitation. While these embodiments of the invention have been described with reference to numerous specific details, one of ordinary skill in the art will recognize that the invention can be embodied in other specific forms without departing from the spirit of the invention. For instance, since the idle fuel dispenser nozzle warning system monitors flow of information and warns the user when it stops, it is possible that the idle fuel dispenser nozzle warning system can be adapted for other applications where humans need some assistance in maintaining awareness of something that can either cause damage or a hazardous condition or simply waste if forgotten.

To use the idle fuel dispenser nozzle warning system and the idle fuel dispenser nozzle warning process of the present disclosure, a gas station owner would either opt to retrofit their current dispensers with the computing device, strobe light, and alarm speaker, or purchase fuel dispensers with the computing device, strobe light, and alarm speaker already built-in. In this way, a gas station owner may reduce the number of drive-offs (people forgetting the nozzle in their tank and driving away) and may reduce their risk and liability regarding an environmental hazardous spill of fuel.

Figure 3:
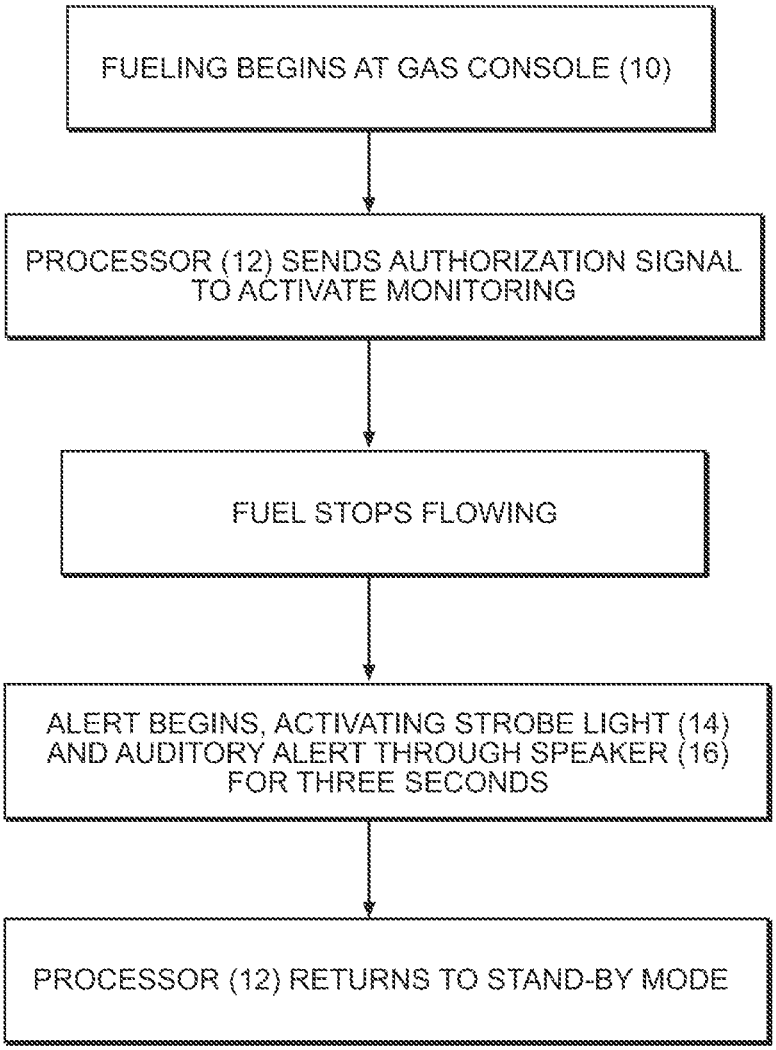
FIG. 3 conceptually illustrates an idle fuel dispenser nozzle warning process for detecting inactivity by a nozzle removed from a nozzle boot of a fuel dispenser and activating a sensory alarm to remind a user to replace the nozzle in the nozzle boot of the fuel dispenser.

By way of example, FIG. 3 conceptually illustrates an idle fuel dispenser nozzle warning process for detecting inactivity by a nozzle removed from a nozzle boot of a fuel dispenser and activating a sensory alarm to remind a user to replace the nozzle in the nozzle boot of the fuel dispenser. As shown in this figure, the idle fuel dispenser nozzle warning process starts when a gas console detects and shows that fueling begins via a fuel dispenser with a nozzle. Next, the computing device processor sends an authorization signal to activate monitoring of fuel flow from the nozzle. At some point, the fuel may stop flowing. The user may stop pumping fuel because the gas tank is full, or a limited amount of fuel is wanted and reached. When the fuel stops flow, the idle fuel dispenser nozzle warning process tracks the time, until triggering an alert. When the alert begins, the computing device processor activates the strobe light to start flashing the warning light and activates the speaker to start sounding the audible alarm. The idle fuel dispenser nozzle warning process may activate the strobe light and the speaker for three seconds and continue as needed to a next level of alarm intensity. For example, the strobe light may flash faster or the light may shine brighter after the three seconds expires and the nozzle is not replaced in the nozzle boot of the fuel dispenser, and/or the audible alert may sound louder than before. After the nozzle is replaced in the nozzle boot, then the idle fuel dispenser nozzle warning process moves to the final step in which the computing device processor retunes to stand-by mode, awaiting the next fuel transaction to begin.

In some embodiments, the idle fuel dispenser nozzle warning process for detecting inactivity by a nozzle removed from a nozzle boot of a fuel dispenser and activating a sensory alarm to remind a user to replace the nozzle in the nozzle boot of the fuel dispenser is implemented as a software program that runs on the computing device (or processor). In this specification, the term "software" is meant to include firmware residing in read-only memory or applications stored in magnetic storage, which can be read into memory for processing by a processor. Also, in some embodiments, multiple software instances of the idle fuel dispenser nozzle warning process for detecting inactivity by a nozzle removed from a nozzle boot of a fuel dispenser and activating a sensory alarm to remind a user to replace the nozzle in the nozzle boot of the fuel dispenser or other processes can be implemented as sub-parts of a larger program while remaining distinct software applications of associated processes. In some embodiments, multiple software inventions can also be implemented as separate programs that run on separating computing devices or a single computing device in separate memory spaces. Finally, any combination of separate programs that together implement idle fuel dispenser nozzle warning process described here is within the scope of the invention. In some embodiments, the software programs, when installed to operate on one or more electronic systems, define one or more specific machine implementations that execute and perform the operations of the software programs. As such, a general electronic system architecture that relates to a general computing device can implement the idle fuel dispenser nozzle warning process for detecting inactivity by a nozzle removed from a nozzle boot of a fuel dispenser and activating a sensory alarm to remind a user to replace the nozzle in the nozzle boot of the fuel dispenser of the present disclosure. The general electronic system may be a small form factor computer, such as a Raspberry Pi, or may be an integrated circuit board ("ICB") manufactured and programmed specifically to be embedded in newly manufactured fuel dispensing stations or retrofit into existing, deployed fuel dispensers.

In some embodiments, the idle fuel dispenser nozzle warning process for detecting inactivity by a nozzle removed from a nozzle boot of a fuel dispenser and activating a sensory alarm to remind a user to replace the nozzle in the nozzle boot of the fuel dispenser is implemented as software that runs on multiple computing devices that are deployed as a network of computing devices. In some embodiments, the network of computing devices includes wired or wireless connection to a central server computing device. In some embodiments, the networked central computing device provides an administrative interface through which all connected computing devices and the corresponding software program installed and running on the computing devices can be configured. In this way, an administrator of several gas stations with multiple fuel dispensing stations can configure the timed event thresholds and the alarm intensities (i.e., brightness of the strobe light that flashes at each triggering event, volume of the speaker sounding the audible alarm at each triggering event, etc.) for all stations via the single administrative interface.

Figure 4:
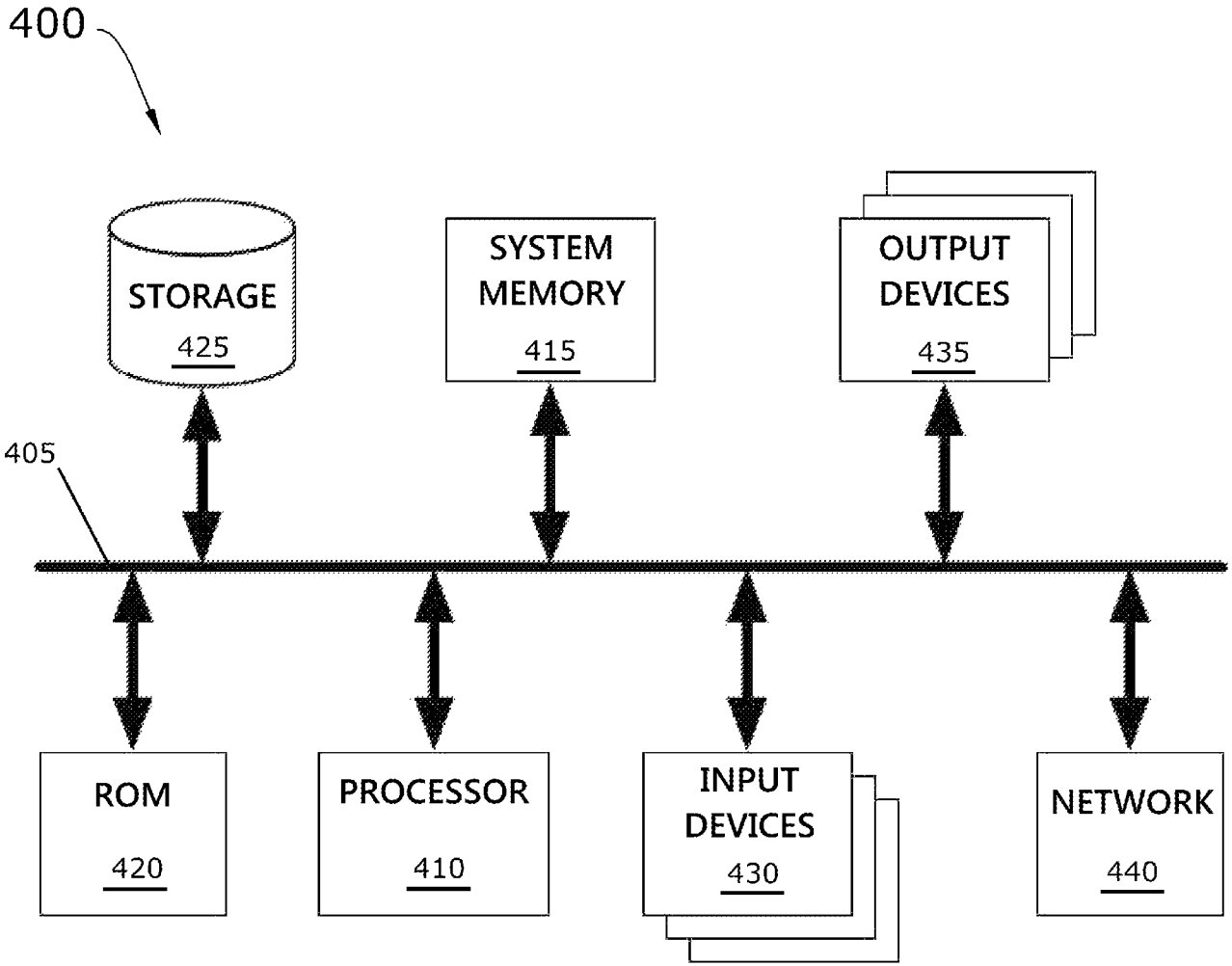
FIG. 4 conceptually illustrates an electronic system with which some embodiments of the invention are implemented.

By way of example, FIG. 4 conceptually illustrates an electronic system 400 with which some embodiments of the invention are implemented. The electronic system 400 may be a computer, phone, PDA, in-car computer, tablet computing device, smartphone mobile device, or any other sort of electronic device. Such an electronic system includes various types of computer readable media and interfaces for various other types of computer readable media. Electronic system 400 includes a bus 405, processing unit(s) 410, a system memory 415, a read-only 420, a permanent storage device 425, input devices 430, output devices 435, and a network 440.

The bus 405 collectively represents all system, peripheral, and chipset buses that communicatively connect the numerous internal devices of the electronic system 400. For instance, the bus 405 communicatively connects the processing unit(s) 410 with the read-only 420, the system memory 415, and the permanent storage device 425.

From these various memory units, the processing unit(s) 410 retrieves instructions to execute and data to process in order to execute the processes of the invention. The processing unit(s) may be a single processor or a multi-core processor in different embodiments.

The read-only-memory (ROM) 420 stores static data and instructions that are needed by the processing unit(s) 410 and other modules of the electronic system. The permanent storage device 425, on the other hand, is a read-and-write memory device. This device is a non-volatile memory unit that stores instructions and data even when the electronic system 400 is off. Some embodiments of the invention use a mass-storage device (such as a magnetic or optical disk and its corresponding disk drive) as the permanent storage device 425.

Other embodiments use a removable storage device (such as a floppy disk or a flash drive) as the permanent storage device 425. Like the permanent storage device 425, the system memory 415 is a read-and-write memory device. However, unlike storage device 425, the system memory 415 is a volatile read-and-write memory, such as a random access memory. The system memory 415 stores some of the instructions and data that the processor needs at runtime. In some embodiments, the invention's processes are stored in the system memory 415, the permanent storage device 425, and/or the read-only 420. For example, the various memory units include instructions for processing appearance alterations of displayable characters in accordance with some embodiments. From these various memory units, the processing unit(s) 410 retrieves instructions to execute and data to process in order to execute the processes of some embodiments.

The bus 405 also connects to the input and output devices 430 and 435. The input devices enable the user to communicate information and select commands to the electronic system. The input devices 430 include alphanumeric keyboards and pointing devices (also called "cursor control devices"). The output devices 435 display images generated by the electronic system 400. The output devices 435 include printers and display devices, such as cathode ray tubes (CRT) or liquid crystal displays (LCD). Some embodiments include devices such as a touchscreen that functions as both input and output devices.

Finally, as shown in FIG. 4, bus 405 also couples electronic system 400 to a network 440 through a network adapter (not shown). In this manner, the computer can be a part of a network of computers (such as a local area network ("LAN"), a wide area network ("WAN"), or an intranet), or a network of networks (such as the Internet). Any or all components of electronic system 400 may be used in conjunction with the invention. The network adapter that supports network computing also supports cloud computing architectures, such as software-as-a-service ("SaaS") cloud computing architectures, in which the network of computing devices include wired or wireless connection to an idle fuel dispenser nozzle warning cloud service that is hosted by a cloud server computing device. In some embodiments, the connection to the idle fuel dispenser nozzle warning cloud service is a private cloud connection that is encrypted end-to-end from each fuel dispensing station in the local or wide network of fuel dispensers and from any administrator computing device (administrative interface) through the private cloud and to the cloud server computing device and one or more connected systems, such as cloud database storages and database management systems.

These functions described above can be implemented in digital electronic circuitry, in computer software, firmware or hardware. Thus, the functions described above may directly implemented and manufactured into fuel dispensing stations, instead of, or in addition to, embedding a computing device with the software program installed and running. Any such directly included firmware or hardware (such as a specially manufactured ICB) also may include programmable interfaces that allow for programming the software at the time of manufacture or after deployment of the fuel dispensing station with integrated firmware/hardware and software. In doing so, the techniques can be implemented using one or more computer program products. Programmable processors and computers can be packaged or included in mobile devices and synchronized with onboard firmware/hardware or embedded computing device. For example, a Bluetooth connection between mobile device and embedded Raspberry Pi to allow a systems engineer or administrator to install or update the software which implements the idle fuel dispenser nozzle warning process.

Some embodiments include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media may store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the invention has been described with reference to numerous specific details, one of ordinary skill in the art will recognize that the invention can be embodied in other specific forms without departing from the spirit of the invention. For instance, FIG. 3 conceptually illustrates a process. The specific operations of the process may not be performed in the exact order shown and described. Specific operations may not be performed in one continuous series of operations, and different specific operations may be performed in different embodiments. Furthermore, the process could be implemented using several sub-processes, or as part of a larger macro process. Thus, one of ordinary skill in the art would understand that the invention is not to be limited by the foregoing illustrative details, but rather is to be defined by the appended claims.

I claim:

1. An idle fuel dispenser nozzle warning system that alerts a user to replace a nozzle in a nozzle boot of a fuel dispenser, said idle fuel dispenser nozzle warning system comprising:

a computing device that is embedded in a fuel dispensing station, said computing device comprising a processor and a storage disk;

a software program that is installed on the computing device, stored in the storage disk of the computing device, and runs on the processor of the computing device, said software program configured to (i) detect fuel line engagement when fuel starts flowing through a fuel line and a nozzle of the fuel dispensing station, (ii) detect a fuel line disengagement event when fuel stops flowing through the fuel line and the nozzle, (iii) start a timer upon detection of the fuel line disengagement event to track time elapsed since fuel line disengagement, (iv) determine whether a timer reset event comprising one of a fuel line re-engagement and a replacement of the nozzle in a nozzle boot of the fuel dispensing station occurs before the tracked time of the timer exceeds a threshold time duration, (v) reset the timer when the timer reset event occurs before the tracked time exceeds the threshold time duration, and (vi) trigger an alert when the timer reset event does not occur before the tracked time exceeds the threshold time duration; and a sensory alert warning device that activates a sensory alert when the software program triggers the alert.

2. The idle fuel dispenser nozzle warning system of claim 1, wherein the sensory alert warning device comprises a spark-free strobe light.

3. The idle fuel dispenser nozzle warning system of claim 2, wherein the sensory alert comprises a visible light warning that is repeatedly flashed by the spark-free strobe light.

4. The idle fuel dispenser nozzle warning system of claim 1, wherein the sensory alert warning device comprises an audio speaker.

5. The idle fuel dispenser nozzle warning system of claim 4, wherein the sensory alert comprises an audible warning sounded out by the audio speaker.

6. The idle fuel dispenser nozzle warning system of claim 1, wherein the threshold time duration comprises three seconds.

7. An idle fuel dispenser nozzle warning process for detecting a time period of inactivity of flowing fuel through a nozzle removed from a nozzle boot of a fuel dispenser and activating a sensory alarm to remind a user to replace the nozzle in the nozzle boot of the fuel dispenser, said idle fuel dispenser nozzle warning process comprising:

detecting when fuel starts flowing through a fuel line and a nozzle of a fuel dispenser;

monitoring the flow of fuel through the fuel line and the nozzle to detect when the fuel stops flowing;

detecting a first event at which the fuel stops flowing through the fuel line and the nozzle;

determining whether an expected fuel dispenser event occurs before a triggering timer elapses for a timed wait period after the first event at which the fuel stops flowing;

activating an alert when the expected fuel dispenser event does not occur before the triggering timer elapses for the timed wait period after the first event at which the fuel stops flowing; and resetting, when the expected fuel dispenser event occurs before the triggering timer elapses for the timed wait period after the first event at which the fuel stops flowing, the first event and the triggering timer for the timed wait period.

8. The idle fuel dispenser nozzle warning process of claim 7, wherein the timed wait period is three seconds.

9. The idle fuel dispenser nozzle warning process of claim 7, wherein the alert comprises an audible alert warning that is sounded by a speaker device integrated into the fuel dispenser.

10. The idle fuel dispenser nozzle warning process of claim 7, wherein the alert comprises a visible alert warning that is made by a strobe light that flashes a light on and off for visual warning.

11. The idle fuel dispenser nozzle warning process of claim 7, wherein the expected fuel dispenser event comprises a replacement of the nozzle in a nozzle boot of the fuel dispenser.

12. The idle fuel dispenser nozzle warning process of claim 7, wherein the expected fuel dispenser event comprises a re-engagement of the flow of fuel through the fuel line and the nozzle.

* * * * *